US008365388B2

(12) United States Patent
Jones et al.

(10) Patent No.: US 8,365,388 B2
(45) Date of Patent: Feb. 5, 2013

(54) METHOD OF JOINING PLATES OF MATERIAL TO FORM A STRUCTURE

(75) Inventors: Richard M. Jones, Colne (GB); Oliver M. Strother, Leeds (GB)

(73) Assignee: Rolls-Royce PLC, London (GB)

( * ) Notice: Subject to any disclaimer, the term of this patent is extended or adjusted under 35 U.S.C. 154(b) by 515 days.

(21) Appl. No.: 12/654,504

(22) Filed: Dec. 22, 2009

(65) Prior Publication Data

US 2010/0186215 A1 Jul. 29, 2010

(30) Foreign Application Priority Data

Jan. 28, 2009 (GB) ..... 0901318.6

(51) Int. Cl.
*B21D 39/00* (2006.01)

(52) U.S. Cl. ..... 29/521; 72/61

(58) Field of Classification Search ..... 29/521; 72/54–63

See application file for complete search history.

(56) References Cited

U.S. PATENT DOCUMENTS

| | | | | |
|---|---|---|---|---|
| 2,202,014 A | | 5/1940 | Lougheed | |
| 3,111,747 A | | 11/1963 | Johnson | |
| 3,736,638 A | * | 6/1973 | Stone, Jr. | 29/889.72 |
| 3,927,817 A | | 12/1975 | Hamilton et al. | |
| 4,217,397 A | | 8/1980 | Hayase et al. | |
| 4,292,375 A | | 9/1981 | Ko | |
| 4,304,821 A | | 12/1981 | Hayase et al. | |
| 4,331,284 A | * | 5/1982 | Schulz et al. | 228/157 |
| 4,522,860 A | | 6/1985 | Scott et al. | |
| 4,530,197 A | * | 7/1985 | Rainville | 52/783.15 |
| 4,583,914 A | * | 4/1986 | Craig et al. | 416/204 A |
| 4,642,863 A | * | 2/1987 | Schulz | 29/889.72 |
| 4,655,014 A | | 4/1987 | Krecke | |
| 4,811,890 A | | 3/1989 | Dowling et al. | |
| 4,882,823 A | | 11/1989 | Weisert et al. | |
| 5,007,225 A | * | 4/1991 | Teasdale | 52/783.17 |
| 5,143,276 A | | 9/1992 | Mansbridge et al. | |

(Continued)

FOREIGN PATENT DOCUMENTS

| | | |
|---|---|---|
| EP | 0 130 583 A2 | 1/1985 |
| EP | 0 181 203 A2 | 5/1986 |

(Continued)

OTHER PUBLICATIONS

Apr. 16, 2012 Office Action issued in U.S. Appl. No. 12/216,502.

(Continued)

*Primary Examiner* — David Bryant
*Assistant Examiner* — Jacob Cigna
(74) *Attorney, Agent, or Firm* — Oliff & Berridge, PLC

(57) ABSTRACT

A method of joining plates of material to form a predetermined structure, the method comprising: assembling a first plate (40) of a material comprising at least one recess (100) against a second plate (80) of material such that the at least one recess (100) of the first plate (40) is in an exterior surface of the first plate (40) on a side of the first plate opposite to the side which faces the second plate (80); bonding a portion (120) of the first and second plates (40, 80) to one another; superplastically forming the bonded plates, wherein the superplastic forming causes the material of the second plate (80) which is opposite to the at least one recess (100) of the first plate (40) to be driven towards the recess (100), and wherein the unbonded portion of the second plate (80) is deflected away from the plate to form the predetermined structure.

16 Claims, 5 Drawing Sheets

U.S. PATENT DOCUMENTS

| | | | | |
|---|---|---|---|---|
| 5,240,376 | A | 8/1993 | Velicki | |
| 5,243,758 | A * | 9/1993 | LeMonds et al. | 29/889.72 |
| 5,253,419 | A | 10/1993 | Collot et al. | |
| 5,323,953 | A | 6/1994 | Adderley et al. | |
| 5,330,092 | A | 7/1994 | Gregg et al. | |
| 5,384,959 | A | 1/1995 | Velicki | |
| 5,419,039 | A | 5/1995 | Auxier et al. | |
| 5,469,618 | A | 11/1995 | Lemonds et al. | |
| 5,534,354 | A | 7/1996 | Gregg et al. | |
| 5,544,805 | A | 8/1996 | Alassoeur et al. | |
| 5,570,552 | A | 11/1996 | Nehring | |
| 5,692,881 | A | 12/1997 | Leibfried | |
| 5,723,225 | A | 3/1998 | Yasui et al. | |
| 5,821,506 | A * | 10/1998 | Matsen | 219/615 |
| 5,826,332 | A | 10/1998 | Bichon et al. | |
| 5,881,459 | A | 3/1999 | Yasui | |
| 5,941,446 | A | 8/1999 | Yasui | |
| 6,039,542 | A | 3/2000 | Schilling et al. | |
| 6,139,278 | A | 10/2000 | Mowbray et al. | |
| 6,224,341 | B1 | 5/2001 | Fricke | |
| 6,287,080 | B1 | 9/2001 | Evans et al. | |
| 6,331,217 | B1 | 12/2001 | Burke et al. | |
| 6,419,146 | B1 | 7/2002 | Buldhaupt et al. | |
| 6,467,168 | B2 | 10/2002 | Wallis | |
| 6,669,447 | B2 | 12/2003 | Norris et al. | |
| 6,720,087 | B2 | 4/2004 | Fried et al. | |
| 6,893,211 | B1 | 5/2005 | Eibl et al. | |
| 6,979,180 | B2 * | 12/2005 | Motherwell | 416/229 R |
| 7,025,568 | B2 | 4/2006 | Jones | |
| 7,070,390 | B2 * | 7/2006 | Powell | 416/224 |
| 7,144,222 | B2 | 12/2006 | Lanni et al. | |
| 7,247,003 | B2 | 7/2007 | Burke et al. | |
| 7,311,500 | B2 | 12/2007 | Rongong et al. | |
| 7,431,197 | B2 | 10/2008 | Franchet et al. | |
| 7,470,114 | B2 | 12/2008 | Bonnet | |
| 7,753,654 | B2 | 7/2010 | Read et al. | |
| 2002/0014101 | A1 | 2/2002 | Yajima | |
| 2003/0136815 | A1 | 7/2003 | Debaisieux et al. | |
| 2003/0156942 | A1 | 8/2003 | Villhard | |
| 2003/0164255 | A1 | 9/2003 | Borroni-Bird et al. | |
| 2004/0018091 | A1 | 1/2004 | Rongong et al. | |
| 2004/0191069 | A1 | 9/2004 | Motherwell | |
| 2006/0066133 | A1 | 3/2006 | Ueno et al. | |
| 2006/0255098 | A1 | 11/2006 | Runyan | |
| 2007/0065291 | A1 | 3/2007 | Karafillis | |
| 2007/0243070 | A1 | 10/2007 | Matheny | |
| 2007/0243408 | A1 | 10/2007 | Straza | |
| 2009/0057488 | A1 | 3/2009 | Goldfinch et al. | |
| 2009/0057489 | A1 | 3/2009 | Goldfinch et al. | |
| 2009/0057718 | A1 | 3/2009 | Suvorov et al. | |
| 2009/0060718 | A1 | 3/2009 | Goldfinch et al. | |
| 2009/0304517 | A1 | 12/2009 | Strother | |
| 2010/0021693 | A1 | 1/2010 | Goldfinch et al. | |
| 2010/0186215 | A1 | 7/2010 | Jones et al. | |

FOREIGN PATENT DOCUMENTS

| | | | |
|---|---|---|---|
| EP | 0 209 867 | A2 | 1/1987 |
| EP | 0 358 523 | A1 | 3/1990 |
| EP | 0 418 179 | A1 | 3/1991 |
| EP | 0 469 221 | A1 | 2/1992 |
| EP | 0 354 631 | B1 | 6/1992 |
| EP | 0 500 458 | A1 | 8/1992 |
| EP | 0 520 827 | A2 | 12/1992 |
| EP | 0 527 564 | A1 | 2/1993 |
| EP | 0 549 172 | A1 | 6/1993 |
| EP | 0 555 534 | A2 | 8/1993 |
| EP | 0 582 795 | A1 | 2/1994 |
| EP | 0 594 885 | A1 | 5/1994 |
| EP | 0 765 711 | A1 | 4/1997 |
| EP | 0 716 273 | B1 | 3/1998 |
| EP | 0 926 312 | A2 | 6/1999 |
| EP | 1 013 355 | A2 | 6/2000 |
| EP | 1 085 288 | A1 | 3/2001 |
| EP | 0 594 886 | B1 | 7/2001 |
| EP | 1 160 752 | A1 | 12/2001 |
| EP | 1 184 768 | A2 | 3/2002 |
| EP | 1 024 330 | B1 | 11/2002 |
| EP | 0 886 813 | B1 | 1/2003 |
| EP | 1 327 489 | A1 | 7/2003 |
| EP | 1 355 212 | A1 | 10/2003 |
| EP | 1 433 993 | A1 | 6/2004 |
| EP | 1 460 347 | A1 | 9/2004 |
| EP | 1 460 507 | A2 | 9/2004 |
| EP | 1 466 692 | A1 | 10/2004 |
| EP | 1 491 980 | A2 | 12/2004 |
| EP | 1 541 953 | A1 | 6/2005 |
| EP | 1 561 901 | A2 | 8/2005 |
| EP | 1 160 640 | B1 | 2/2006 |
| EP | 1 653 165 | A1 | 5/2006 |
| EP | 1 811 129 | A2 | 7/2007 |
| EP | 2 014 384 | A1 | 1/2009 |
| EP | 2 014 386 | A1 | 1/2009 |
| EP | 2 014 387 | A1 | 1/2009 |
| EP | 2 014 388 | A1 | 1/2009 |
| EP | 2 014 869 | A1 | 1/2009 |
| EP | 2 223 766 | A1 | 9/2010 |
| GB | 842937 | A | 7/1960 |
| GB | 1 367 958 | A | 9/1974 |
| GB | 1 437 510 | A | 5/1976 |
| GB | 2 124 520 | A | 2/1984 |
| GB | 2 154 287 | A | 9/1985 |
| GB | 1 284 867 | A | 7/1987 |
| GB | 2 193 306 | A | 2/1988 |
| GB | 2 198 264 | A | 6/1988 |
| GB | 2 202 619 | A | 9/1988 |
| GB | 2 206 685 | A | 1/1989 |
| GB | 2 211 593 | A | 7/1989 |
| GB | 2 228 069 | A | 8/1990 |
| GB | 2 249 615 | A | 5/1992 |
| GB | 2 251 063 | A | 6/1992 |
| GB | 2 261 032 | A | 5/1993 |
| GB | 2 298 265 | A | 8/1996 |
| GB | 2 305 720 | A | 4/1997 |
| GB | 2 360 070 | A | 9/2001 |
| GB | 2 371 095 | A | 7/2002 |
| GB | 2 387 669 | A | 10/2003 |
| GB | 2 391 270 | A | 2/2004 |
| GB | 2 393 498 | A | 3/2004 |
| GB | 2 397 855 | A | 8/2004 |
| GB | 2 401 407 | A | 11/2004 |
| GB | 2 402 716 | A | 12/2004 |
| GB | 2 408 295 | A | 5/2005 |
| GB | 2 411 462 | A | 8/2005 |
| GB | 2 416 228 | A | 1/2006 |
| GB | 2 450 934 | A | 1/2009 |
| GB | 2 450 935 | A | 1/2009 |
| JP | A-2008-133825 | | 6/2008 |
| WO | WO 97/27045 | A2 | 7/1997 |
| WO | WO 00/70271 | A1 | 11/2000 |
| WO | WO 01/56332 | A1 | 8/2001 |
| WO | WO 01/82018 | A2 | 11/2001 |
| WO | WO 02/48615 | A2 | 6/2002 |
| WO | WO 03/025469 | A1 | 3/2003 |
| WO | WO 03/042607 | A1 | 5/2003 |
| WO | WO 03/093916 | A2 | 11/2003 |
| WO | WO 2004/102077 | A1 | 11/2004 |
| WO | WO 2005/022953 | A1 | 3/2005 |
| WO | WO 2005/045326 | A1 | 5/2005 |
| WO | WO 2005/067619 | A2 | 7/2005 |
| WO | WO 2005/069820 | A2 | 8/2005 |
| WO | WO 2005/071510 | A1 | 8/2005 |

OTHER PUBLICATIONS

British Search Report cited in British Patent Application No. GB0901318.6, on Mar. 18, 2009.

Mar. 7, 2012 Office Action issued in U.S. Appl. No. 12/453,435.

Mar. 12, 2012 Notice of Allowance issued in U.S. Appl. No. 12/216,503.

Mar. 20, 2012 Office Action issued in U.S. Appl. No. 12/216,505.

Sep. 2, 2009 European Search Report issued in European Application No. 09 25 1341.

Dec. 14, 2010 Search Report issued in British Application No. GB1020063.2.

Jul. 28, 2009 Search Report issued in British Patent Application No. 0907004.6.

Jul. 27, 2010 Search Report issued in European Patent Application No. EP 10 15 7495.2.
Jan. 19, 2010 Search Report issued in British Patent Application No. 0916687.7.
May 19, 2010 European Search Report issued in related European Patent Application No. 09252779.5 (with Abstract).
May 5, 2009 British Search Report issued in related British Patent Application No. GB0901235.2.
Oct. 7, 2008 European Search Report issued in European Patent Application No. 08 01 1077.
Oct. 20, 2008 European Search Report issued in European Patent Application No. 08 01 1078.
Oct. 21, 2008 European Search Report issued in European Patent Application No. 08 01 1079.
Dec. 7, 2010 Search Report issued in British Application No. GB1013305.6.
Sep. 2, 2010 Search Report issued in British Application No. GB1009216.1.
Sep. 15, 2009 Search Report issued in British Application No. GB0911416.6.
May 11, 2011 Partial European Search Report issued in European Application No. 10 16 5255.
Sep. 22, 2008 Search Report issued in British Application No. GB0808840.3.
Aug. 28, 2007 Search Report issued in British Application No. GB0713700.3.
Sep. 16, 2008 Search Report issued in British Application No. GB0813539.4.
Mar. 7, 2008 Search Report issued in British Application No. GB0713699.7.
Oct. 12, 2007 Search Report issued in British Application No. GB0713699.7.
Jul. 26, 2011 Office Action issued in U.S. Appl. No. 12/453,762.
Sep. 12, 2011 Office Action issued in U.S. Appl. No. 12/453,762.
Dec. 21, 2011 Notice of Allowance issued in U.S. Appl. No. 12/453,762.
Jul. 1, 2011 Office Action issued in U.S. Appl. No. 12/216,503.
Dec. 27, 2011 Notice of Allowance issued in U.S. Appl. No. 12/216,503.
Sep. 26, 2011 Office Action issued in U.S. Appl. No. 12/453,435.
Feb. 25, 2011 Office Action issued in U.S. Appl. No. 12/216,505.
Jun. 2, 2011 Office Action issued in U.S. Appl. No. 12/216,505.
Nov. 23, 2011 Office Action issued in U.S. Appl. No. 12/216,505.
Feb. 3, 2011 Office Action issued in U.S. Appl. No. 12/216,497.
Jul. 20, 2011 Office Action issued in U.S. Appl. No. 12/216,497.
Mar. 9, 2011 Notice of Allowance issued in U.S. Appl. No. 12/216,502.
Dec. 6, 2010 Office Action issued in U.S. Appl. No. 12/216,502.
U.S. Appl. No. 13/299,671 in the name of Strother, filed Nov. 18, 2011.
U.S. Appl. No. 12/645,211 in the name of Strother, filed Dec. 14, 2009.
U.S. Appl. No. 12/844,215 in the name of Harron, filed Jul. 27, 2010.
U.S. Appl. No. 12/730,641 in the name of Strother, filed Mar. 24, 2010.
U.S. Appl. No. 12/216,503 in the name of Goldfinch et al, filed Jul. 7, 2008.
U.S. Appl. No. 13/186,850 in the name of Goldfinch et al, filed Jul. 20, 2011.
U.S. Appl. No. 13/114,382 in the name of Strother, filed May 24, 2010.
U.S. Appl. No. 12/453,762 in the name of Goldfinch, filed May 21, 2009.
U.S. Appl. No. 12/216,505 in the name of Strother, filed Jul. 7, 2008.
U.S. Appl. No. 12/453,435 in the name of Strother, filed May 11, 2009.
U.S. Appl. No. 12/796,231 in the name of Mason, filed Jun. 8, 2010.
U.S. Appl. No. 13/008,323 in the name of Strother, filed Jan. 18, 2011.
U.S. Appl. No. 12/720,253 in the name of Strother, filed Mar. 9, 2010.
U.S. Appl. No. 12/720,351 in the name of Strother, filed Mar. 9, 2010.
U.S. Appl. No. 12/216,502 in the name of Goldfinch et al., filed Jul. 7, 2008.
U.S. Appl. No. 12/216,497 in the name of Goldfinch et al., filed Jul. 7, 2008.
Sep. 6, 2012 Office Action issued in U.S. Appl. No. 12/216,505.

* cited by examiner

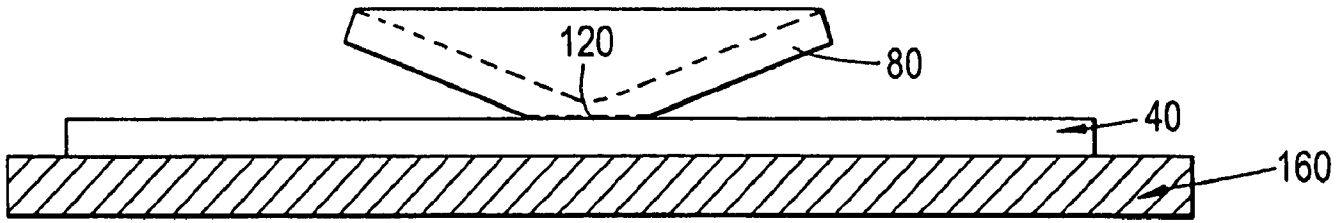
Fig.4(iii)

METHOD OF JOINING PLATES OF MATERIAL TO FORM A STRUCTURE

This invention relates to a method of joining plates of material to form a structure, and particularly but not exclusively relates to applications of the method in hollow aerofoil components for turbomachines or heat exchanger components.

It is known to manufacture hollow metallic aerofoils for example to be used as blades in a jet engine, and in particular fan blades for a turbomachine, by superplastic forming and diffusion bonding metallic panels, the panels forming pressure and suction surfaces of the blade. These blades are generally referred to as wide-chord fan blades. These structures are widely used in the civil aerospace industry and may also be used in blisks, particularly in military applications. The metallic panels may include elementary metal, metal alloys and metal matrix composites. At least one of the metallic panels must be capable of superplastic extension. In one known process the surfaces of the panels to be joined are cleaned, and at least one surface of one or more of the panels is coated in preselected areas with a stop-off material to prevent diffusion bonding. The panels are arranged in a stack and the edges of the panels are welded together, except where a pipe is welded to the panels, to form an assembly. The pipe enables a vacuum, or inert gas pressure, to be applied to the interior of the assembly. The assembly is placed in an autoclave and heated so as to "bake out" the binder from the material to prevent diffusion bonding. The assembly is then evacuated, using the pipe, and the pipe is sealed. The sealed assembly is placed in a pressure vessel and is heated and pressed to diffusion bond the panels together to form an integral structure. Diffusion bonding occurs when two mat surfaces are pressed together under temperature, time and pressure conditions that allow atom interchange across the interface. The first pipe is removed and a second pipe is fitted to the diffusion bonded assembly at the position where the first pipe was located. The integral structure is located between appropriately shaped dies and is placed within an autoclave. The integral structure and dies are heated and pressurised fluid is supplied through the second pipe into the interior of the integral structure to cause at least one of the panels to be superplastically formed to produce an article matching the shape of the dies.

In addition to the hollow assembly just described, it is also known to insert a membrane between the metallic panels prior to the above described process. The location of diffusion bonds between the membrane and the adjacent panels can be controlled by applying the stop-off material to preselected areas on each side of the membrane (or respective panels). When the aerofoil is subsequently expanded, the membrane adheres to the panels where the diffusion bond is allowed to form and thereby provides an internal structure. The internal structure is provided to increase the strength and stiffness of the aerofoil and also to prevent lateral flexing of the panels, referred to as "panting".

The assembly may be filled or part filled by a suitable material to provide damping of the structure and therefore to reduce vibration. A suitable material may be one which possesses viscoelastic properties. Viscoelasticity is a property of a solid or liquid which when deformed exhibits both viscous and elastic behaviour through the simultaneous dissipation and storage of mechanical energy. A known method is to introduce a viscoelastic material, for example a Huntsman™ syntactic damping paste or some such similar product, into the cavity by injecting or otherwise introducing the material into some or all of the cavity. This technique may be applied in a hollow assembly wherein the cavity is smooth walled with no internal structure, for example see patent application number GB0130606.7. In this configuration the viscoelastic material is restrained solely by the bond between the viscoelastic material and the walls of the cavity. If this bond is not sufficient to retain the viscoelastic material during working conditions, in particular centrifugal loading, then, since the viscoelastic material is a parasitic mass which is unable to support its own weight, the hydrostatic load of the unrestrained material will cause the blade to fail rapidly. Accordingly, the consequences of failure of this bond are severe. It is therefore desirable to provide some form of mechanical keying as an alternative or additional means of retaining and restraining the viscoelastic material. An internal structure, for example as described above, may be used to provide such a restraining or retaining effect on the injected material. However by providing a rigid internal structure the benefits of damping the aerofoil may be reduced as the aerofoil is less flexible as a result of the internal structure. This may lead to additional problems where the aerofoil prematurely fatigues or cracks as a result of the reduced flexibility. Other configurations use internal ribs, which may be attached to alternate interior walls of the aerofoil but which are not connected to one another, for example see patent application number GB0713699.7. This configuration permits damping of the assembly whilst the re-entrant features still provide a means of retaining the injected material. Other methods use dual membranes to produce a lightweight internal structure in the aerofoil, for example see patent application number GB0808840.3.

The internal structure is such that it may advantageously bear a significant load under normal working conditions which allows the thickness of the panels to be reduced and the size of the cavity to be increased. Also the internal structure may provide additional birdstrike resistance. However the use of an internal structure to physically restrain the viscoelastic material inevitably adds weight to the aerofoil and thus increases the stresses on the aerofoil, in particular at the root of the aerofoil. This increases the blade off energy if the blade were to fail, which must be taken into account when designing the blade retention system. In addition the provision of complex internal structures increases manufacturing costs and lead times. It is therefore desirable to provide an improved method of restraining a viscoelastic material within a cavity which addresses some or all of the above problems associated with the prior art methods.

In accordance with a first aspect of the present invention a method of joining plates of material to form a predetermined structure is provided, the method comprising: assembling a first plate of a material comprising at least one recess against a second plate of material such that the at least one recess of the first plate is in an exterior surface of the first plate on a side of the first plate opposite to the side which faces the second plate; bonding a portion of the first and second plates to one another; superplastically forming the bonded plates, wherein the superplastic forming causes the material of the second plate which is opposite to the at least one recess of the first plate to be driven towards the recess of the first plate, and wherein the unbonded portion of the second plate is deflected away from the first plate to form the predetermined structure.

The method may further comprise: assembling a third plate of a material comprising at least one recess against the second plate of material such that the at least one recess of the third plate is in an exterior surface of the third plate on a side of the third plate opposite to the side which faces the second plate; bonding a portion of the third and second plates to one another; wherein the superplastic forming further causes the material of the second plate which is opposite to the at least one recess of the third plate to be driven towards the recess, and wherein the unbonded portion of the second plate is deflected away from the third plate to form the predetermined structure.

Following the superplastic forming, the at least one recesses of the first and third plates may be reduced in size.

The positions of the at least one recesses of the first and third plates may be offset from one another.

The at least one recesses of the first and third plates may be arranged along the length of the plates in an alternating arrangement.

The at least one recesses of the first and/or third plates may be substantially opposite to the bonded portion of the plate.

The bonding may be by diffusion bonding.

The second plate may comprise one or more passages extending through the thickness of the plate.

The one or more passages may be slots and/or holes.

The bonded portion may be bonded adjacent, across, or between the one or more passages.

The at least one recesses of the first and/or third plates may be substantially the same width as the bonded portion.

The depth of the at least one recess of the first and/or third plates may be substantially equal to the thickness of the second plate.

The exterior surface of the first and/or third plates may be superplastically formed against a die.

Following the superplastic forming the exterior surface of the first and/or third plate may be substantially planar.

The predetermined structure may be one or more of: a conical structure, a flower shaped structure, a baffle, a framework, a girder, a warren girder or a split warren girder.

The method may further comprise introducing a damping material between the first and third plates.

The damping material may be a viscoelastic material.

The predetermined structure may be adapted to restrain the damping material.

The one or more passages may be adapted to allow the damping material to pass through them.

For a better understanding of the present invention, and to show more clearly how it may be carried into effect, reference will now be made, by way of example, to the accompanying drawings, in which:—

Figure 1:
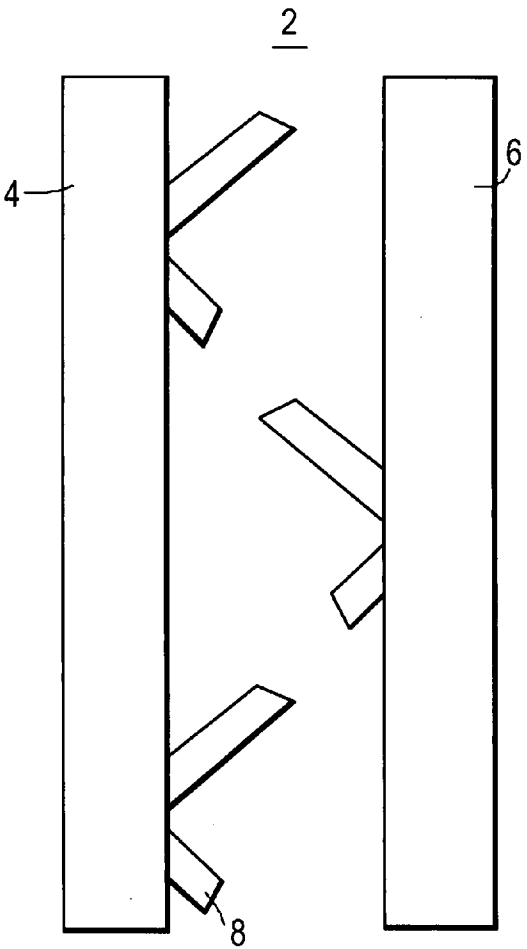
FIG. 1 shows a cross-section through an assembly showing a method of joining plates of material in accordance with a first embodiment of the invention.
Figure 1I:
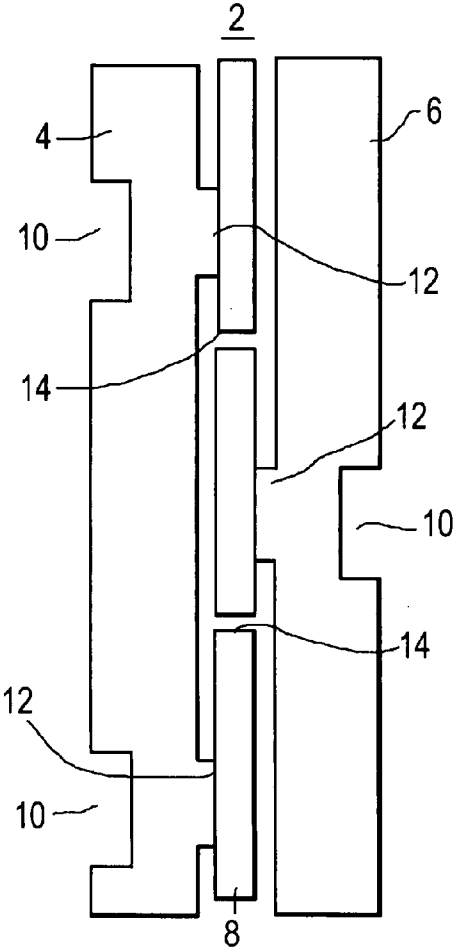

FIG. 1 shows a cross-section through an assembly 2 according to a first embodiment of the invention. The assembly 2 may form an aerofoil assembly, such as that used as a fan blade for a turbomachine or other suitable applications which shall be described herein. The assembly 2 comprises a first plate of a material 4, a second plate of a material 8 and a third plate of a material 6. The material of the first, second and third plates may include elementary metals, metal alloys and metal matrix composites. In particular the plates may be made from titanium, although other materials may be used. As shown in FIG. 1(*i*) the second plate of material 8 is sandwiched between the first and third plates 4, 6. The second plate 8 may be thinner than the first and third plates 4, 6. The first and third plates 4, 6 are provided with one or more recesses 10 positioned on an exterior surface of the plates. Although the third plate 6 is shown with only one recess 10, the assembly 2 may be repeated to form a longer assembly comprising a plurality of recesses on both plates 4, 6. The recesses 10 of the first plate 4 and the recesses 10 of the third plate 6 may be arranged so that they are located at different positions along the length of the assembly 2. The recesses 10 thus form an alternating pattern such that the recess of the third plate 6 falls in between adjacent recesses 10 of the first plate 4, and vice versa. Although the recesses 10 of the third plate 6 are shown as falling substantially in the centre of the two adjacent recesses 10 of the first plate 4, it is envisaged that other patterns may be used wherein the distance between adjacent recesses of the overall assembly 2 are not equal and may vary along the length of the assembly 2. This may be advantageous for enabling certain sections of the assembly to have desired properties, which will be described in more detail below.

The second plate 8 is bonded to the first and third plates at positions along the length of the assembly 2 which are substantially opposite to the recesses 10. The second plate 8 may be bonded by any known method for example brazing or welding, however as described previously it is advantageous to bond the assembly using diffusion bonding. As previously described the diffusion bonding process requires the assembly to be exposed to heat, pressure and time conditions which allow atom interchange. In order to selectively bond only certain areas of the assembly, for example at the areas opposite to the recesses 10, it is first necessary to apply a stop-off material at the locations where bonding is not required. The stop-off material is selected depending on the material of the plates and for plates manufactured from titanium the stop-off material may be Yttria. The stop-off material may be applied to the internal surfaces of the first and third plates 4, 6 and/or the surfaces of the second plate 8. This may be by means of screen-printing or other known methods of applying the stop-off material and is applied to all surfaces except where bonds are desired. As previously described, the plates are then arranged in a stack and the edges of the plates welded together to form an assembly. A vacuum, or inert gas pressure, is applied to the interior of the assembly. The assembly is then placed in an autoclave and heated so as to "bake out" the binder from the material to prevent diffusion bonding. The assembly is then evacuated and sealed. The sealed assembly is placed in a pressure vessel and is heated and pressed to create diffusion bonds 12 between the plates. The diffusion bonds 12 are at positions which are substantially opposite to the recesses 10 and thus an integral assembly 2 is formed.

As shown in FIG. 1(*ii*), the integral assembly 2 is subsequently inflated or expanded. An example of an appropriate method of inflating the assembly 2 is as follows, however other known techniques may be used. The assembly 2 is located between appropriately shaped dies (not shown) and the assembly 2 and dies are heated and pressurised fluid is supplied into the interior of the assembly 2 to cause at least one of the plates to be formed to produce an article matching the shape of the dies. The forming of the plates may be superplastic. As a result of this process, the second plate 8 is deformed so as to extend between the adjacent bonds 12 located on the first and second plates 4, 6. The second plate therefore forms an internal structure which is determined by the configuration of the bonds 12. As shown in FIG. 1, the internal structure may be a warren girder structure or split warren girder structure, however this structure may be altered by varying the distance between bonds and alternative structures may be used. In addition the portions of the second plate 8 which are bonded and also the bonds 12 themselves are formed so as to reduce the size of the recesses 10, with the unbonded portions being deformed to extend between the bonds. The dimensions of the recesses 10 may designed so as to facilitate this process by making them of approximately the same width as the bonds 12, or conversely the stop-off material may be applied to achieve bonds 12 of the desired width. It may be advantageous for the recesses to slightly larger or smaller than the bonds depending on the required reduction in size. In addition, the depth of the recess may be approximately the same as the thickness of the second plate so that the recess is substantially removed by the addition of the material of the second plate. The mechanism by which the recess is reduced in size may be through the replacement of the recess by the material of the first or third plate below the recess which is forced into the recess by the second plate, as the assembly is inflated into the shape of the dies. Alternatively the recess may be reduced in size by material from the first or third plate and from the material of the second plate. The process depends on the size of the recess and the thickness of the material adjacent the recess. In certain embodiments the recess may be a hole through the plate and may therefore be reduced in size by the material of the second plate only. The material of the first or third plates and the second plate may be fused during the process. Furthermore the cross-section of the recesses 10 need not be rectangular and other cross-sections may be used for purposes of manufacturing convenience and also for providing desired properties for the resulting structure. For example, a concave recess may produce a structure with reduced stresses at the bonding positions. It is desirable that the recesses are substantially filled so that the exterior surfaces of first and third plates 4, 6 are substantially planar, however it may also be advantageous in certain applications for the recess to be partially filled or to be overfilled so as to form a protrusion. This may be particularly beneficial in applications where it is desirable to modify the turbulence along the surface of the assembly.

The hollow cavity formed following inflation of the assembly 2 may be filled or partially filled with a damping material, such as a viscoelastic material, as previously described. This may be injected or introduced into the cavity via any suitable means. For example a fill hole may be drilled in the surface of one of the plates to enable to material to be injected into the cavity.

The second plate 8 may be provided with passages 14 through the thickness of the plate. The passages 14 may be slots, holes or other apertures which may be laser cut, waterjet cut or formed by any other known method. Alternatively the surface of the second plate 8 may be scored or perforated so that during the forming of the assembly the plate fails creating two distinct ribs from the section of the plate. For example see the method described in patent application number GB0713699.7. The passages 14 are not only useful for allowing the pressurised fluid and damping material to pass between the cavities defined by the structure of the second plate 8, but also provides a mechanical key for restraining the damping material. The damping material does not therefore rely solely on a bond or frictional interaction with the interior surfaces of the cavity and is more robustly affixed to withstand working loads. In addition, the passages increase the flexibility of the structure enabling the damping material to operate effectively.

In accordance with the first embodiment of the invention the passages 14 may be located substantially in the centre of the section of the second plate 8 extending between adjacent bonds or alternatively may be offset along this section, as is shown in FIG. 1. However other embodiments of the invention which are described below employ alternative locations for the passages 14. The locations of the passages 14 need not be constant throughout the assembly 2 and the various embodiments may be used within a single assembly 2 so as to produce desirable properties for the resulting aerofoil.

The orientation of the internal structure created by the second plate 8 within the assembly 2 need not be as shown and may extend in the spanwise or chordwise directions of the aerofoil or be angled in any other direction. In addition, the orientation of the internal structure may vary within the aerofoil. For example, the structure near the tip of the aerofoil may extend substantially parallel to the tip. This may be desirable since the steady stresses at the tip are lower and the parallel configuration maximises strength of the tip against impact caused by, for example, a birdstrike. Towards the root of the aerofoil the structure may extend substantially parallel to the length of the aerofoil so as to enhance the steady strength of the aerofoil.

Figure 2:
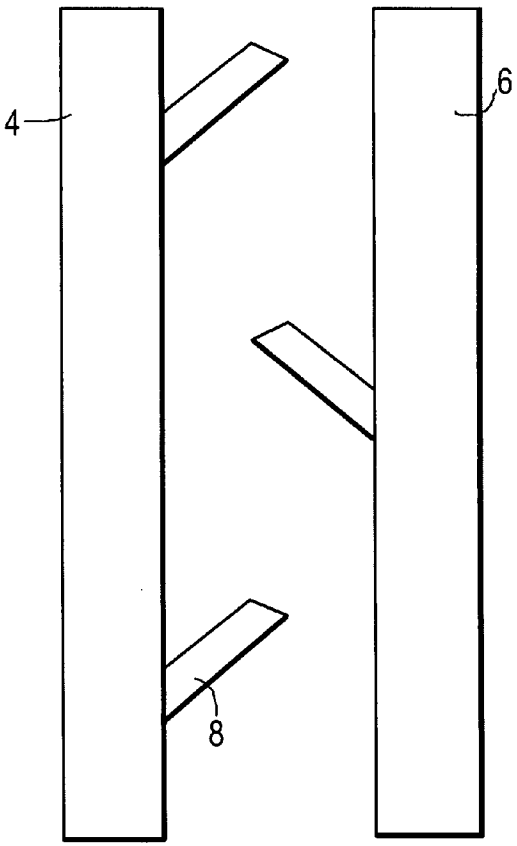
FIG. 2 shows a cross-section through an assembly showing a method of joining plates of material in accordance with a second embodiment of the invention.
Figure 2I:
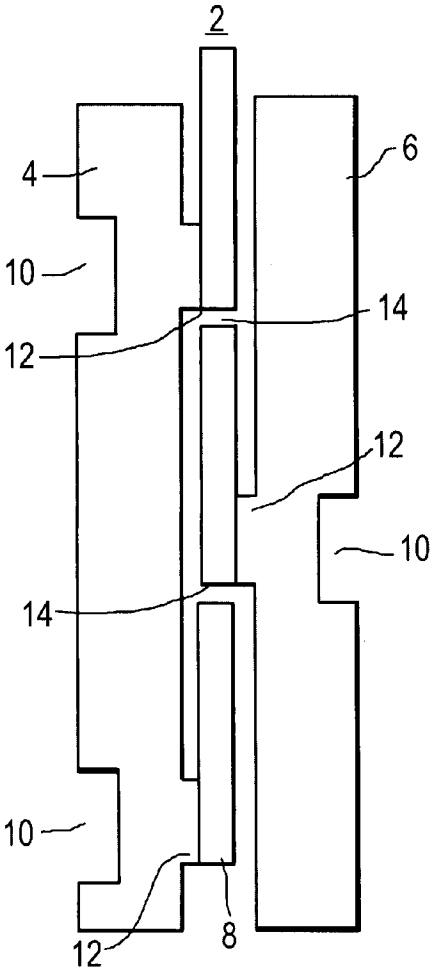

Referring now to FIG. 2, in which an assembly 2 in accordance with a second embodiment of the present invention is shown. The second embodiment of the invention is substantially as per the first embodiment and corresponding features are denoted with the same reference numerals.

The second embodiment of the invention differs from the first embodiment in that second plate 8 is assembled with the first and third plates 4, 6 so that the passages 14 are aligned substantially with an edge of the recesses 10. The stop-off material is applied to the assembly in a manner so that the edge of the diffusion bond 12 is also aligned with the edge of the passage 14. Alternatively the second plate 8 may be bonded to the first and third plates 4, 6 in this manner by any other suitable method. As described previously the passages may be slots or holes or formed by scoring or perforating the surface of the third plate so that during the forming of the assembly the plate fails creating two distinct ribs from the section of the plate. The assembly 2 is then inflated, as described in relation to the first embodiment, creating the resulting structure shown in FIG. 2(*ii*). Since the bonds are formed at the edges of the passages 14 the second plate 8 forms fingers extending into the cavity from opposing walls in an alternate pattern. The resulting structure may be altered by varying the distance between bonds to produce fingers of different inclination and this may vary within a single aerofoil. Similarly to the first embodiment, the inflation of the assembly and forming against the dies causes the material of the second plate 8 and bonds 12 which are located opposite to the recesses 10 to be forced into the recess and thus to reduce the size of the recess.

The resulting structure may be particularly beneficial since the structure gives an increased surface area and provides turbulators so as to increase heat transfer or to resist flow of the damping material. As per the first embodiment, the structure of the second embodiment provides a mechanical key for restraining the damping material. The damping material does not therefore rely on a bond or frictional interaction with the interior surfaces of the cavity and is affixed more robustly to withstand working loads. In addition, the passages increase the flexibility of the structure enabling the damping material to operate effectively.

Figure 3:
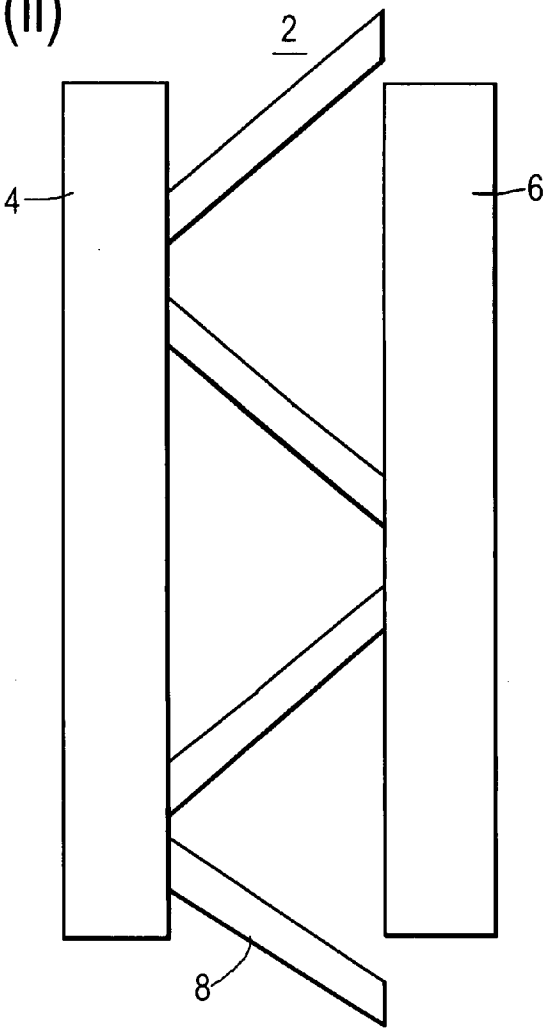
FIG. 3 shows a cross-section through an assembly showing a method of joining plates of material in accordance with a third embodiment of the invention.
Figure 3I:
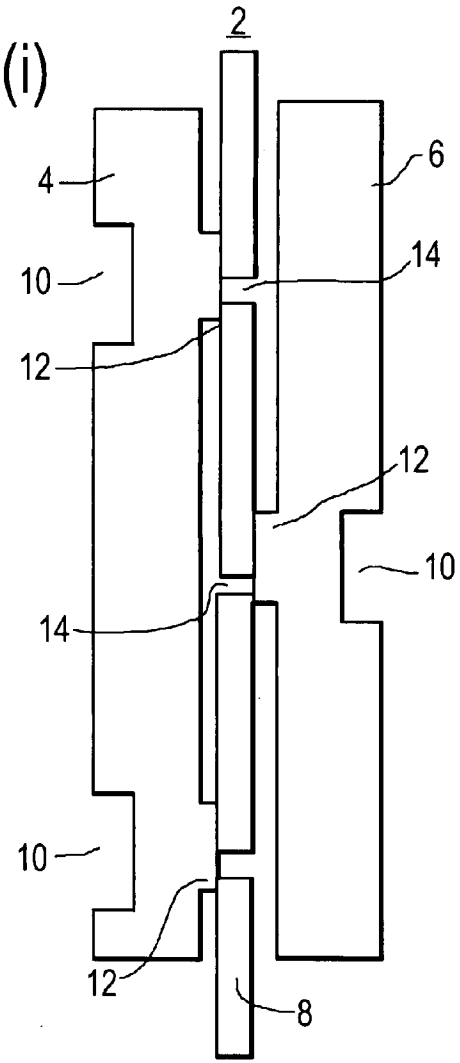

Referring now to FIG. 3, an assembly 2 in accordance with a third embodiment of the present invention is shown. The third embodiment of the invention is substantially as per the first and second embodiment and corresponding features are denoted with the same reference numerals.

The third embodiment of the invention differs from the first embodiment in that second plate 8 is assembled with the first and third plates 4, 6 so that the passages 14 are aligned substantially with the centres of respective recesses 10. The stop-off material is applied to the assembly in a manner so that the diffusion bond 12 is formed across the passage 14. Alternatively the second plate 8 may be bonded to the first and third plates 4, 6 in this manner by any other suitable method. As described previously the passages may be slots or holes or formed by scoring or perforating the surface of the second plate so that during the forming of the assembly the plate fails creating two distinct ribs from the section of the plate. The assembly 2 is then inflated as described in relation to the first embodiment, creating the resulting structure shown in FIG. 3(*ii*). Since the bonds are formed across the passages 14, the second plate 8 forms a warren girder structure. Following inflation the passages 14 may define gaps between each inclined section of the internal structure or alternatively during deformation of the sections of the second plate 8, the passages 14 may be substantially closed. The resulting structure may be altered by varying the distance between bonds to form a structure with different angles and this may also vary within a single aerofoil. Similarly to in the first embodiment, the inflation of the assembly and forming against the dies causes the material of the second plate 8 and bonds 12 which are located opposite to the recesses 10 to be forced into the recess and thus to reduce the size of the recess.

In each of the first three embodiments it can be seen that the impact on the weight of the aerofoil caused by the introduction of the internal structure is minimized since the bonded sections are transferred into the recesses of the aerofoil. This is particularly beneficial in applications relating to fan blades and other rotating parts where increased weight increases loads on the aerofoil and the blade-off energy. Previous methods of bonding the internal structure to the plates resulted in a strain induced radius at the point of attachment. The present invention does not exhibit this problem and therefore the stresses at the bonds are reduced. Although the invention has been shown here with exemplary internal structures, the invention may be applied to produce more complex structures which may incorporate more than one plate sandwiched between the outer plates.

As per the first and second embodiments, the structure of the third embodiment provides a mechanical key for restraining the damping material. The damping material does not therefore rely on a bond or frictional interaction with the interior surfaces of the cavity and is more robustly affixed to withstand working loads. In addition, the passages increase the flexibility of the structure enabling the damping material to operate effectively.

The present invention has been described in relation to an aerofoil structure particularly for use as a fan blade for a turbomachine, however the invention may be applied to any application where the invention is advantageous which may include applications where a damped cavity is required and in particular where it is necessary to retain the damping material. For example the present invention may be suitable for damped vanes, outlet guide vanes, thrust reverser deflector panels and other components. In the application as a thrust reverser deflector panel the invention may be of particular benefit since the structure may provide noise damping whilst being both low in weight and strong.

Figure 4I:
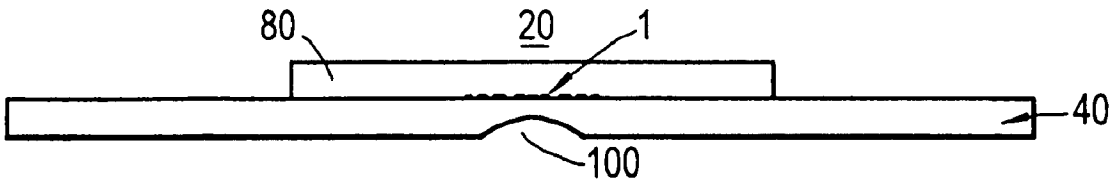
FIG. 4 shows a cross-section through an assembly showing a method of joining plates of material in accordance with a fourth embodiment of the invention.
Figure 4:
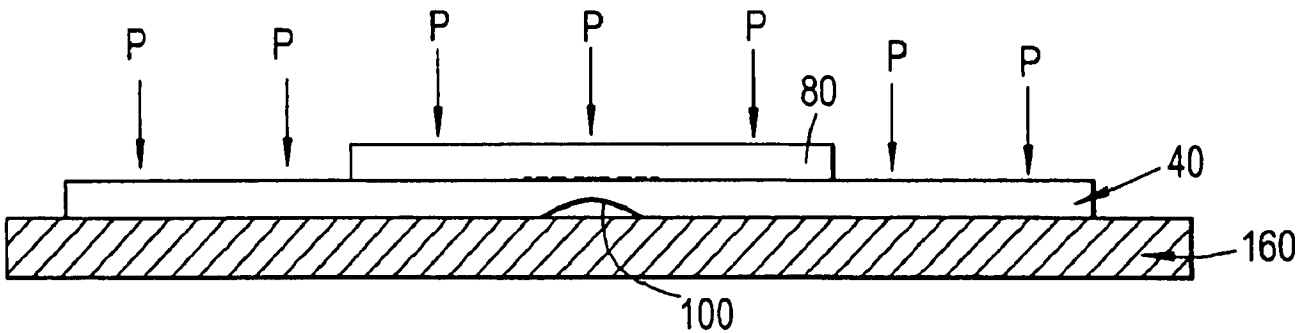

Referring now to FIG. 4, in which an assembly 20 in accordance with a fourth embodiment of the present invention is shown. In contrast to the first three embodiments, the structure of the fourth embodiment is formed from just two plates. The assembly 20 comprises a first plate of a material 40 and a second plate of a material 80. The material of the first and second plates may include elementary metals, metal alloys and metal matrix composites. In particular the plates may be made from titanium, although other materials may be used. As shown in FIG. 4(*i*) the second plate of material 80 is placed on top of the first plate 40. The second plate 80 may be thinner than the first plates 40 and as shown may be shorter than the first plate 40, however this need not be the case and various configurations are envisaged depending on the desired resulting structure. The first plate 40 is provided with one or more recesses 100 positioned on an exterior surface of the plate on the opposite side to that on which the second plate 80 is placed. Although the first plate 40 is shown with only one recess 100, the assembly 2 may be repeated to form a longer assembly comprising a plurality of recesses and a plurality of separate plates 80, as is shown in FIG. 5.

The second plate 80 is bonded to the first plate at a position which is substantially opposite to the recess 100. The second plate 80 may be bonded by any known method for example brazing or welding, however as described previously it is conventional to bond the assembly using diffusion bonding. As previously described the diffusion bonding process requires the assembly to be exposed to heat, pressure and time conditions which allow atom interchange. In order to selectively bond only certain areas of the assembly, for example at the area opposite to the recess 100, it is first necessary to apply a stop-off material at the locations where bonding is not required. The stop-off material is selected depending on the material of the plates and for plates manufactured from titanium the stop-off material may be Yttria. The stop-off material may be applied to either or both of the facing surfaces of the first and second plates 40, 80. This may be by means of screen-printing or other known methods of applying the stop-off material and is applied to all surfaces except where bonds are desired. The assembly 20 may be placed in an autoclave and heated so as to "bake out" the binder from the material to prevent diffusion bonding. The assembly may be placed in a pressure vessel and heated and pressed to create a diffusion bond 120 between the plates. The diffusion bond 120 is at a position which is substantially opposite to the recess 10 and thus a bonded assembly 20 is formed.

As shown in FIG. 4(*ii*) the bonded assembly is placed against a die 160 and the assembly 20 and die 160 are heated and pressurised fluid is supplied in a direction perpendicular to the top surfaces of the plates, as denoted by the arrows. The pressurised fluid acts on the second plate 80 and causes the material opposite to the recess 100 to be forced flat against the die 160, thus reducing the size of the recess 100 as previously described. This forming process may be superplastic. As a result of this process, the unbonded portions of second plate 80 are deflected away from the first plate 40 so as to produce a structure as shown in FIG. 4(*ii*). The angle by which the second plate 80 is deformed is related to the dimensions of the recess 100 and to the degree to which the recess is reduced in size as a result of the forming process.

Figure 5:
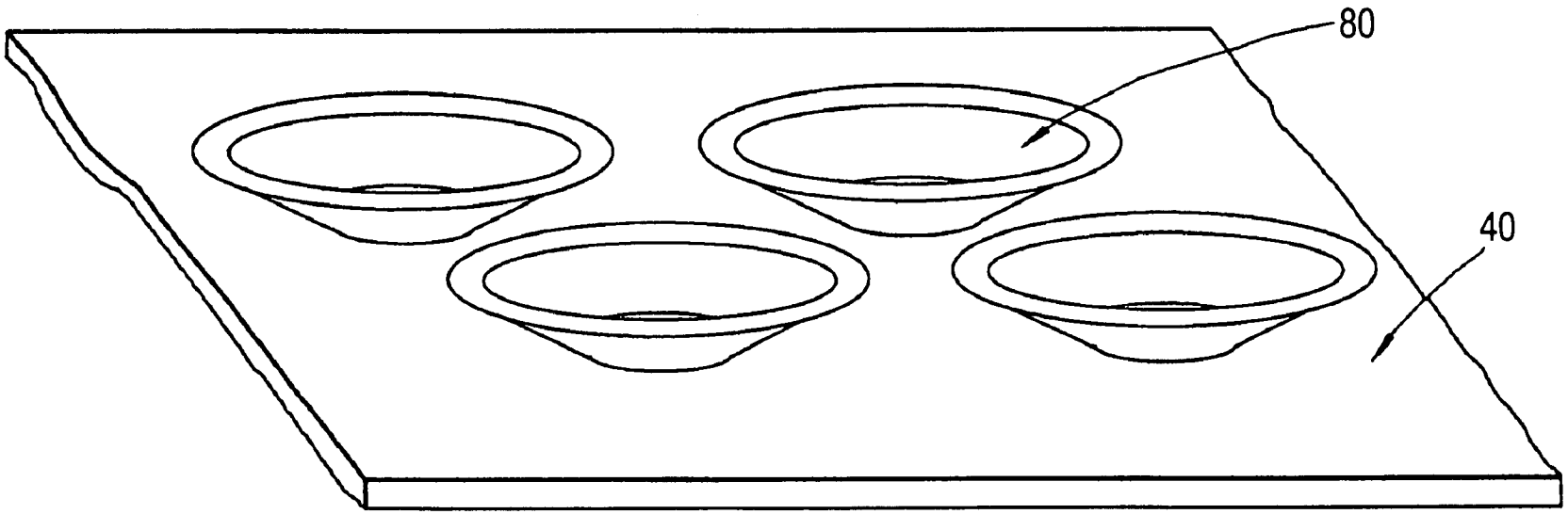
FIG. 5 shows a perspective view of the assembly formed by a method in accordance with the fourth embodiment of the invention, as shown in FIG. 4.

FIG. 5 shows an example structure produced by the method of the fourth embodiment on the invention. Here several second plates 80 and recesses 100 have been used to form the structure and the second plates 80 are circular in shape creating a substantially conical structure. Other shapes of the second plate 80 may be used and may include flower shaped plates. The location of the bond 120 need not be centred on the second plate 80 and by bonding the second plate 80 off centre a non-symmetrical structure may be formed.

The resulting structure may be of particular benefit in applications relating to heat exchangers, since the structure increases the surface area and turbulence.

To avoid unnecessary duplication of effort and repetition of text in the specification, certain features are described in relation to only one or several aspects or embodiments of the invention. However, it is to be understood that, where it is technically possible, features described in relation to any aspect or embodiment of the invention may also be used with any other aspect or embodiment of the invention.

The invention claimed is:

1. A method of joining plates of material to form a predetermined structure, the method comprising:

assembling a first plate of a material comprising at least one recess against a second plate of material such that the at least one recess of the first plate is in an exterior surface of the first plate on a side of the first plate opposite to the side which faces the second plate;

bonding a portion of the first and second plates to one another;

superplastically forming the bonded plates;

assembling a third plate of a material comprising at least one recess against the second plate of material such that the at least one recess of the third plate is in an exterior surface of the third plate on a side of the third plate opposite to the side which faces the second plate;

bonding a portion of the third and second plates to one another, wherein the superplastic forming causes the material of the second plate which is opposite to the at least one recess of the first plate to be driven towards the recess of the first plate, the superplastic forming further causes the material of the second plate which is opposite to the at least one recess of the third plate to be driven towards the recess of the third plate, the unbonded portion of the second plate is deflected away from the third plate to form the predetermined structure, the unbonded portion of the second plate is deflected away from the first plate to form the predetermined structure, and the at least one recesses of the first and third plates are arranged along the length of the plates in an alternating arrangement.

2. A method of joining plates of material to form a predetermined structure as claimed in claim 1, wherein following the superplastic forming, the at least one recesses of the first and third plates are reduced in size.

3. A method of joining plates of material to form a predetermined structure as claimed in claim 1, wherein the positions of the at least one recesses of the first and third plates are offset from one another.

4. A method of joining plates of material to form a predetermined structure as claimed in claim 1, wherein the at least one recesses of the first and/or third plates is substantially opposite to the bonded portion of the second plate.

5. A method of joining plates of material to form a predetermined structure as claimed in claim 1, wherein the bonding is by diffusion bonding.

6. A method of joining plates of material to form a predetermined structure as claimed in claim 1, wherein the at least one recesses of the first and/or third plates is substantially the same width as the bonded portion.

7. A method of joining plates of material to form a predetermined structure as claimed in claim 1, wherein the exterior surface of the first and/or third plates is superplastically formed against a die.

8. A method of joining plates of material to form a predetermined structure as claimed in claim 1, wherein following the superplastic forming the exterior surface of the first and/or third plates is substantially planar.

9. A method of joining plates of material to form a predetermined structure as claimed in claim 1, wherein the predetermined structure is one or more of: a conical structure, a flower shaped structure, a baffle, a framework, a girder, a warren girder or a split warren girder.

10. A method of joining plates of material to form a predetermined structure as claimed in claim 1, wherein the second plate comprises one or more passages extending through the thickness of the second plate.

11. A method of joining plates of material to form a predetermined structure as claimed in claim 10, wherein the one or more passages are slots and/or holes.

12. A method of joining plates of material to form a predetermined structure as claimed in claim 10, wherein the bonded portion is bonded adjacent, across, or between the one or more passages.

13. A method of joining plates of material to form a predetermined structure as claimed in claim 12, wherein the depth of the at least one recesses of the first and/or third plates is substantially the same as the thickness of the second plate.

14. A method of joining plates of material to form a predetermined structure as claimed in claim 1, further comprising introducing a damping material between the first and third plates.

15. A method of joining plates of material to form a predetermined structure as claimed in claim 14, wherein the damping material is a viscoelastic material.

16. A method of joining plates of material to form a predetermined structure as claimed in claim 14, wherein the predetermined structure is adapted to restrain the damping material.

* * * * *